US005413307A

United States Patent [19]

Tidwell

[11] Patent Number: 5,413,307

[45] Date of Patent: May 9, 1995

[54] PRECAST MANHOLE INVERT FORMING

[75] Inventor: Joe Tidwell, Moreland, Ga.

[73] Assignee: The Concrete Company, Columbus, Ga.

[21] Appl. No.: 155,226

[22] Filed: Nov. 22, 1993

[51] Int. Cl.[6] ..... B28B 7/28; B28B 21/86

[52] U.S. Cl. ..... 249/11; 29/455.1; 249/145; 249/176; 264/219

[58] Field of Search ..... 29/455.1; 249/11, 98, 249/99, 100, 145, 176, 177; 264/219, 299

[56] References Cited

U.S. PATENT DOCUMENTS

| | | | |
|---|---|---|---|
| 3,363,876 | 1/1968 | Moore | 249/145 |
| 3,958,313 | 5/1976 | Rossborough | 285/237 |
| 4,177,229 | 12/1979 | Moore | 249/145 |
| 4,318,880 | 3/1982 | McIntosh et al. | 249/145 |
| 4,427,619 | 1/1984 | Peterson | 249/145 |
| 4,565,347 | 1/1986 | Ditcher | 249/83 |
| 4,685,650 | 8/1987 | Ditcher | 249/83 |
| 4,867,411 | 9/1989 | Dorsey et al. | 249/11 |
| 4,941,643 | 7/1990 | Ditcher | 249/145 |

*Primary Examiner*—Jay H. Woo
*Assistant Examiner*—Robert B. Davis
*Attorney, Agent, or Firm*—Shoemaker and Mattare, Ltd.

[57] ABSTRACT

A mold for casting an inverted base section of a manhole includes a core for forming an inner surface of the base section, and a jacket surrounding the core for forming an outer surface of the base section. A domed plate atop the core but below an upper edge of the jacket, and having a peripheral shape corresponding to that of the core, seals off the interior of the core and produces the floor shape of the base section. A trough former is placed between opposite interior sides of the jacket and above the domed plate. The flanges of the trough former are cut along arcs conforming to the shape of the domed plate so that cementitious material poured into the mold does not leak between the domed plate and the trough former. Hole formers are similarly seated atop the trough former.

7 Claims, 6 Drawing Sheets

PRECAST MANHOLE INVERT FORMING

BACKGROUND OF THE INVENTION

This invention relates generally to civil engineering and more particularly to a casting a manhole, that is, a concrete shell that is placed below ground, intersecting a sewer or other conduit, to provide access from above ground.

Because of certain problems which may occur at the point where a sewer pipeline changes direction, or where a junction is formed at the intersection of two or more pipe-lines, manholes are often installed at these locations.

It is necessary, when using a manhole, to insure that sewage flow through the manhole is uninterrupted. Thus, it is common practice to construct a channel or channels in the floor of the manhole connecting the influent and effluent pipe openings in the walls in order to maintain the same rate of flow as that of the sewer pipe. Also, inasmuch as the manhole itself creates an influent source from ground surface water above, and there may be surges in the sewer system, the surface of the floor is usually built with an inward slope which directs water into recessed channels to prevent sewage and debris from collecting on the manhole floor surface. This surface is commonly referred to as the manhole "invert".

Various methods of configuring the floor or invert of the manhole as described above are used. In manholes which are constructed on site, usually of masonry, the invert may be formed by constructing the manhole around a pipe, then breaking out the top portion of the pipe, leaving a trough or channel running through the manhole. However, on-site construction of brick or masonry manholes is time consuming and costly. It has been found that precast concrete sewer manholes are more cost effective, quicker to install, and superior in construction to masonry manholes; therefore, precast manholes are widely used.

it is common practice to manufacture the floor surface of the base section of the precast manhole generally flat and level, perhaps because that is easier. Influent and effluent openings are cast into-the wall at a specified distance above the flat floor surface, to permit the invert channel and sloped floor surface to be constructed in the field once the manhole is in place. This practice, like that used in on-site masonry manhole construction adds labor costs to the manhole and does not eliminate the problems associated with the transportation of materials and equipment to the jobsite.

It would be most desirable for the precast manhole to be produced in such a way that the invert configuration of channels and sloped floor were formed as an integral portion of the base section of the manhole, thus leaving no additional construction to be performed in the field.

Besides the above-described methods of forming a manhole invert in the field, at least one process exists wherein recessed channels are cast into the floor surface as the base section is cast. This process, known as the "Morebase Invert System", is understood to employ a recessed pouring plate which is substituted for the flat pouring plate located over the core of the form used to produce the manhole base section. Various U-shaped channel forms are supplied to accommodate various angles of intersection of pipes into the manhole and are attached to the pouring plate by means of strong magnets. These channel forms are positioned such that they align and abut the forms used to produce the pipe entrance openings in the walls of the manhole.

A number of problems arise in the Morebase system, related both to the manufacturing process as well as the finished product. With respect to manufacture, the channel forms, although held in place by strong magnets, may be dislodged when concrete is poured into the manhole form. Further, a tight fit between each end of the channel form and the corresponding hole form to which it abuts is unlikely, thus giving rise to the possibility of concrete paste entering the void. The resulting flash must be removed in order to open the hole after the product is cured. These manufacturing problems thus detract from product quality, and require labor for correction. Additionally, this design produces a floor surface with substantially flat surfaces that do not drain properly. Thus, the "Morebase" invert forming system, while attempting to eliminate the problems associated with field construction of manhole inverts may be improved upon.

SUMMARY OF THE INVENTION

An object of the invention is to improve the invert configuration in the base section of a precast concrete manhole.

Another object of the invention is to simplify and facilitate the manufacture of precast concrete manholes.

A further object of the invention is to provide an invert forming system which reduces errors in the manufacturing process.

It is another object of the present invention to provide a means of producing a manhole floor surface that is concave, to improve run-off characteristics over that of previous configurations.

Another object is to simplify the casting of troughs and lateral holes in precast manholes.

These and other objects are attained by a mold for casting an inverted base section of a manhole, which mold includes a core for forming an inner surface of the base section, and a jacket surrounding the core for forming an outer surface of the base section. A domed plate disposed atop the core but below an upper edge of said jacket, and having a peripheral shape corresponding to that of the core, seals off the interior of the core. A trough former is placed between opposite interior sides of said jacket and above said dome. The flanges of the trough former are cut along arcs conforming to the shape of the dome so that cementitious material poured into the mold does not leak between the dome and the trough former. Hole formers are similarly seated atop the trough former.

The floor produced by the invention has a half-round or U-shaped channel running between influent and effluent sewer pipe openings in the walls. The floor surface slopes down from the manhole wall to the channel, to produce the desired drainage.

BRIEF DESCRIPTION OF THE DRAWINGS

In the accompanying drawings.

Figure 1:
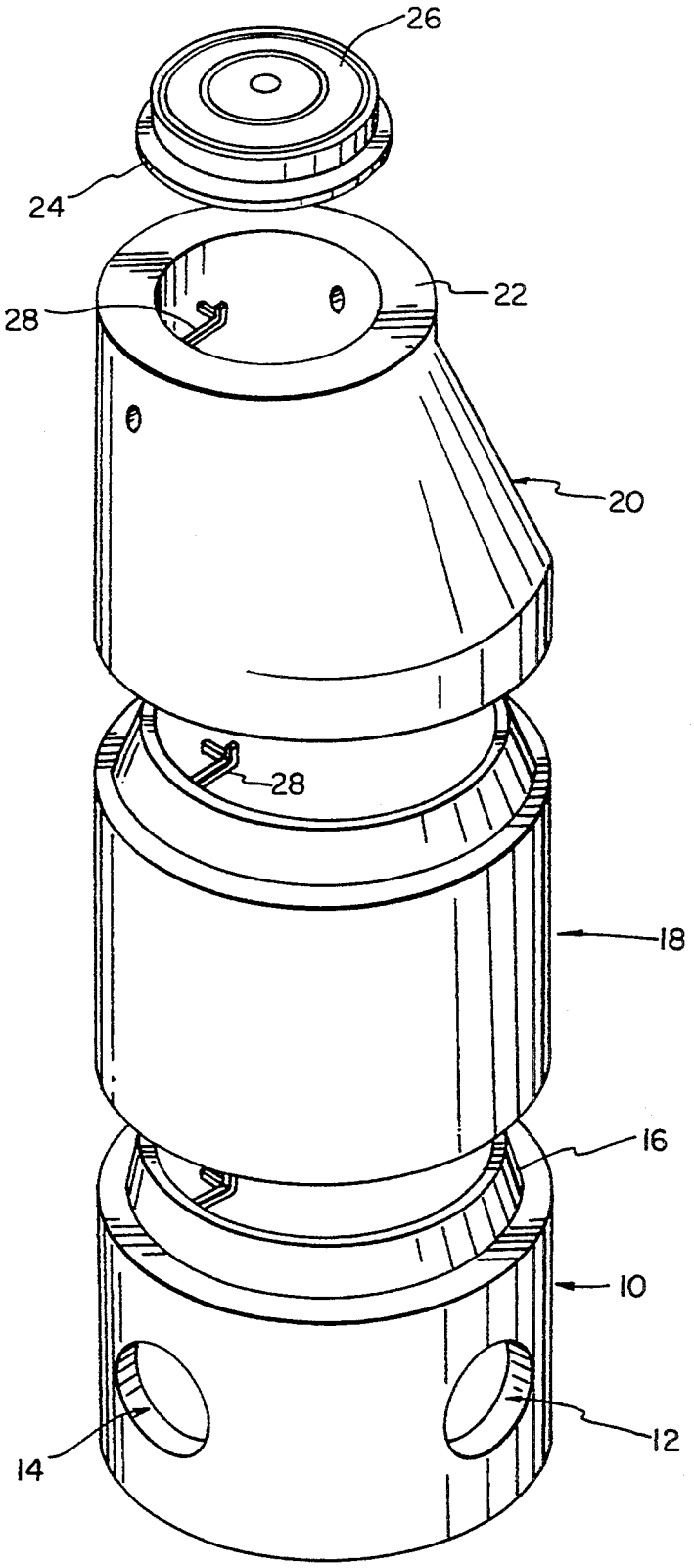
FIG. 1 ( PRIOR ART )
FIG. 1 is an exploded isometric view of the components of a typical prior manhole.

As FIG. 1 shows, a typical prior manhole comprises a base section 10 well below Ground level, having lateral openings 12,14 for receiving influent and effluent pipes (not shown). The pipes are substantially smaller than the openings; the interface may be sealed with heavy rubber couplings as shown, for example, in U.S. Pat. No. 3,958,313.

The upper edge of the base section has an internal peripheral tapered flange 16 which seats within a correspondingly shaped recess at the bottom of a cylindrical riser section 18. The riser supports a cone section 20 whose upper surface 22 is only slightly below ground level. A metal ring 24 is affixed atop the cone section, flush with the ground, and a cover 26 seats in the ring. Items 28 are rungs protruding from the inner surface of the manhole sections.

Figure 2:
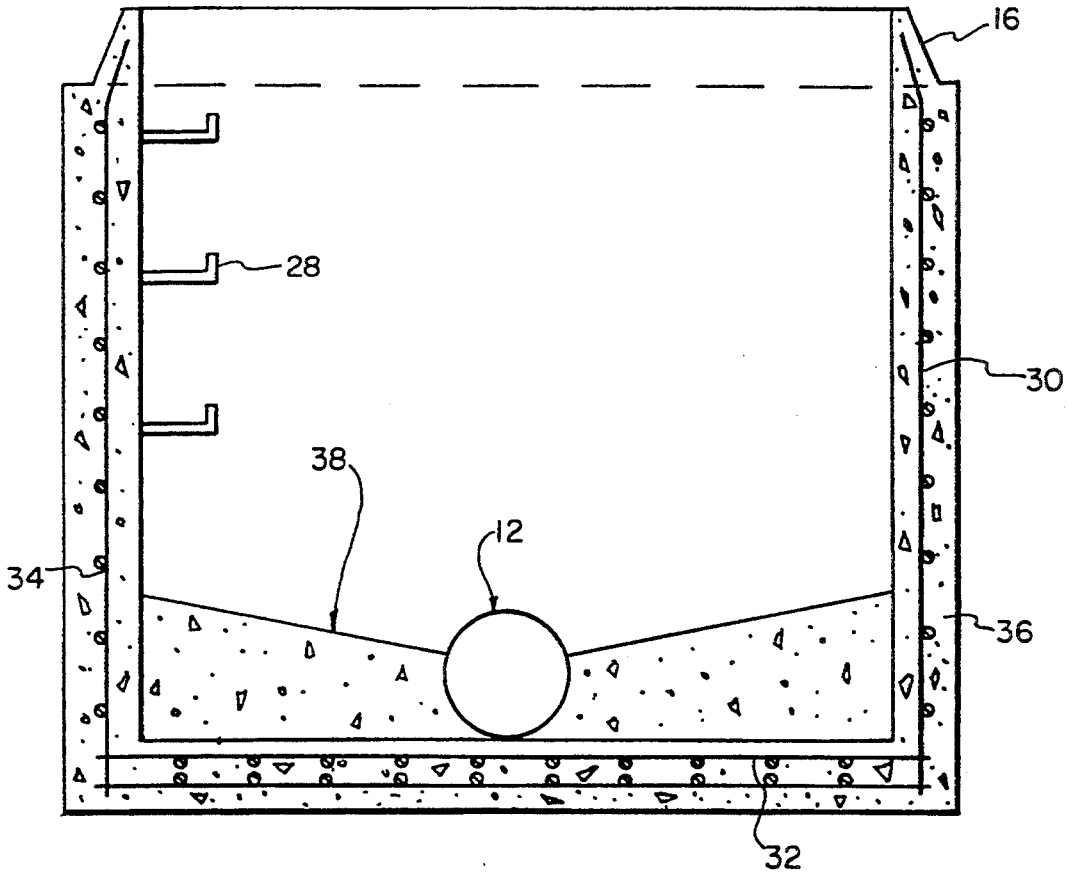
FIG. 2 (PRIOR ART)
FIG. 2 is a sectional view of the base portion of the manhole, taken along the plane 2—2 in FIG. 1.

As this invention is concerned particularly with formation of the base section of the manhole, FIG. 2 depicts a typical prior base section 10 alone, in section. The lines 30,32,34 represent reinforcing rods cast into the concrete 36. The invert 38 is typically field constructed around the pipe opening 12.

Figure 3:
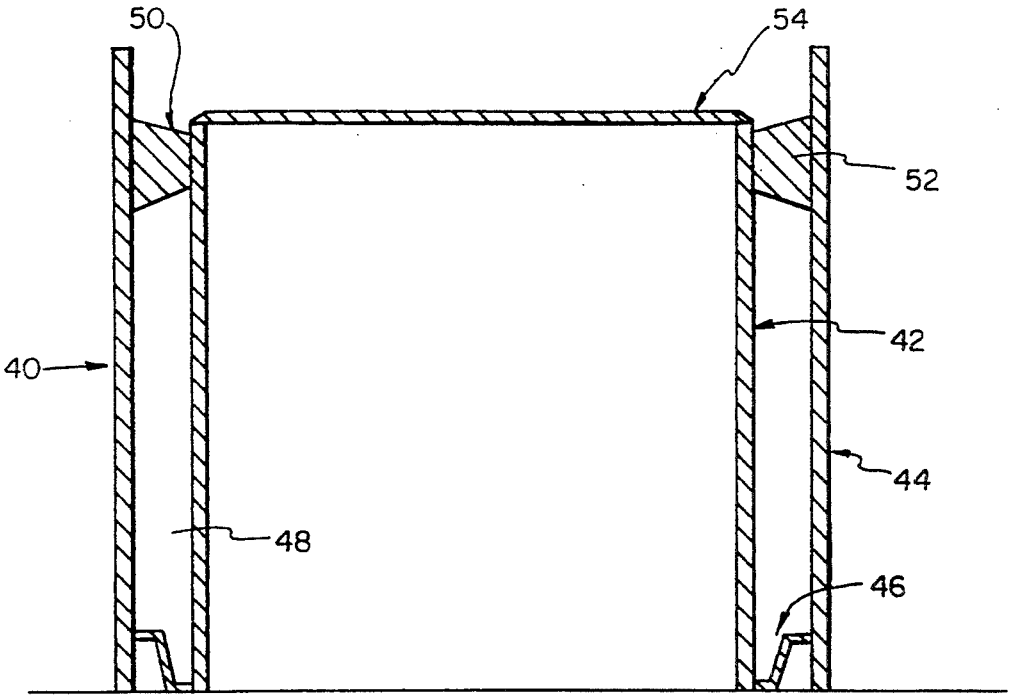
FIG. 3 (PRIOR ART)
FIG. 3 is a corresponding sectional view of an inverted mold for forming the base section by casting.

A prior mold 40 for forming the base section of FIG. 2 is illustrated in FIG. 3. The base section is cast upside down, so FIGS. 2 and 3 appear inverted. This mold has a cylindrical or slightly tapered inner core 42 made of metal, and an outer metal jacket 44. Spacing is maintained between these parts by a lip forming ring 46 at the bottom of the annular space 48 between the parts 42,44. Frustoconical holes formers 50,52 are shown positioned between the parts 42,44, near their upper ends. The upper end of the inner core is sealed by a flat metal plate 54, and the outer jacket rises above the plate by an amount at least equal to the desired floor thickness of the section.

DESCRIPTION OF THE PREFERRED EMBODIMENT OF THE INVENTION

Figure 4:
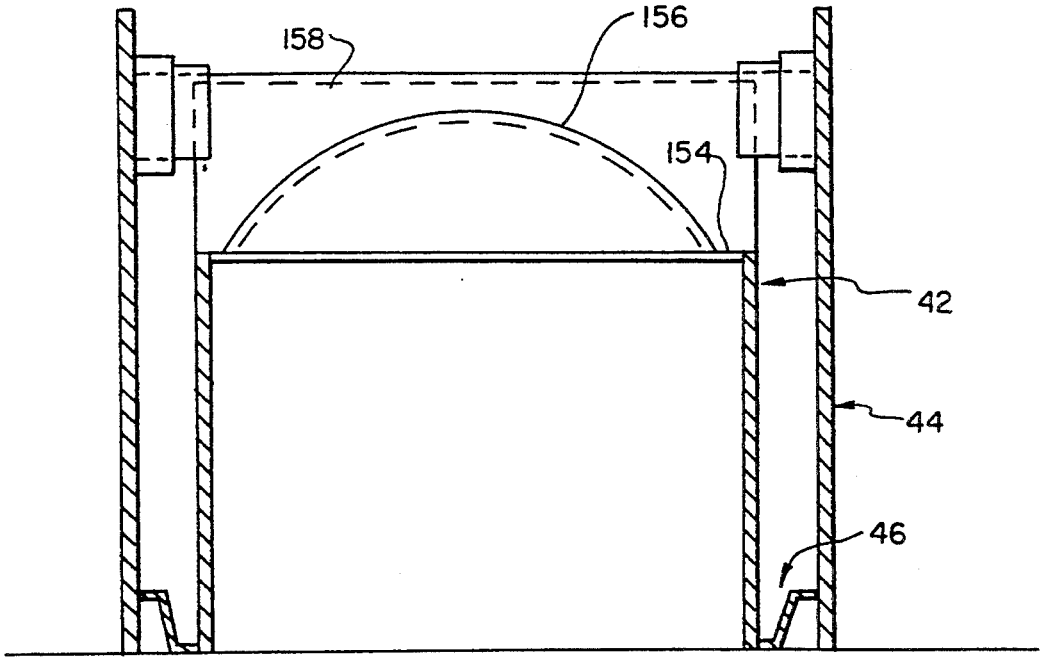
FIG. 4 is a view, corresponding to that of FIG. 3, of an improved mold embodying the invention.

A mold embodying the invention is depicted in FIG. 4. The mold, like that of FIG. 3, has an inner core 42, an outer jacket 44, and a lip forming ring 46 disposed between them, at the bottom of the mold (which corresponds to the top of the base section). The core is slightly tapered, and may have for example a forty-eight inch diameter at the bottom and a forty-seven inch diameter at the top, resulting in about a one degree taper. Note that the hole formers are generally cylindrical, but stepped to produce a counterbore in the wall of the resulting base section.

Figure 5:
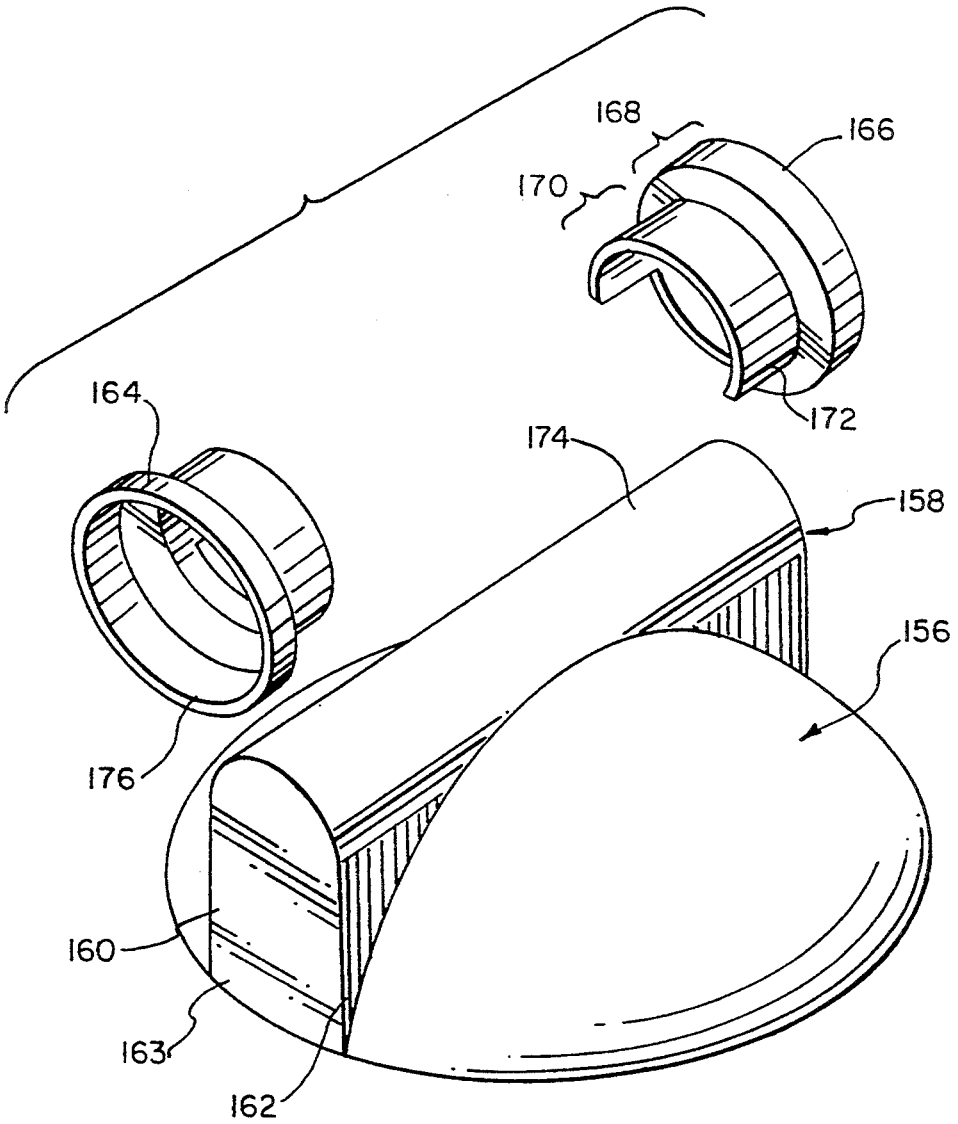
FIG. 5 is an isometric view of the trough former of the invention.

In this mold, the inner core is topped, not by a flat plate, but rather by a domed pouring plate 154 having a dome 156 and a trough former 158 seated on and welded to the dome. The components of the pouring plate 154 are best seen in FIG. 5. The dome 156 itself is the segment of a spherical shell of a predetermined outer radius, and the trough former is 158 a generally U-shaped section whose arms 160,162 are cut away along an arc having a radius like that of the dome. The arms of the "U" diverge somewhat, each at about 7° from a vertical plane. In the device illustrated, the plane of symmetry of the trough former would intersect the center of the spherical shell. This construction is most common, and simpler to design, but off-center alignments are possible.

Figure 6:
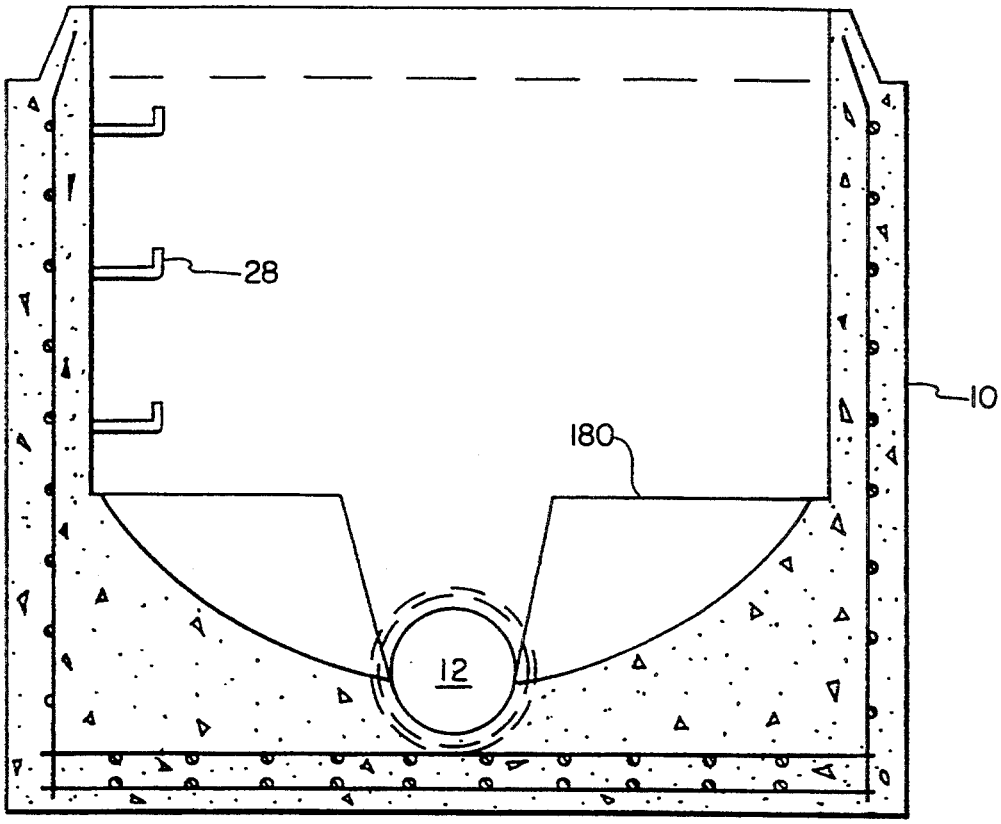
FIG. 6 is a sectional view, corresponding to FIG. 2, of the base section produced by the invention.
Figure 7:
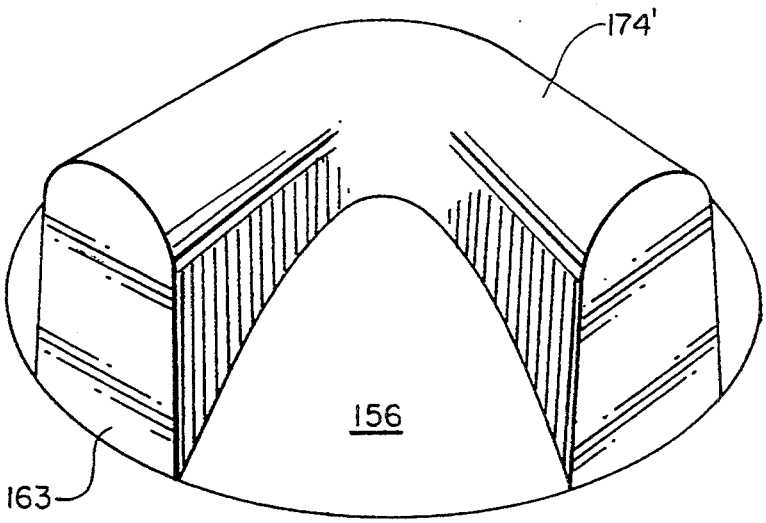
FIGS. 7 and 8 are views, like FIG. 5, of two alternative embodiments of the invention.
Figure 8:
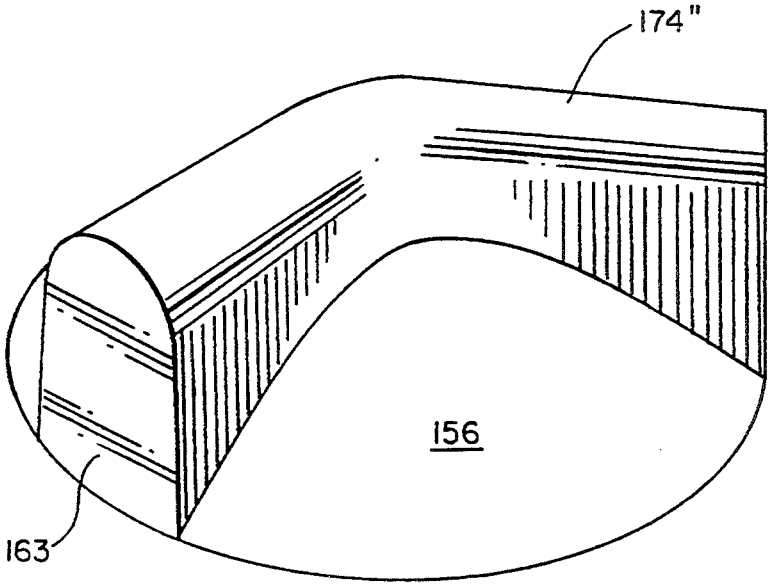

The ends of the trough former are sealed by end plates 163 welded thereto, as shown in FIGS. 5–7.

The hole formers 164,166 illustrated are substantially stepped collars having a larger diameter section 168 outward of the trough former, and a smaller diameter inboard section 170. The lower half of the smaller diameter section of each hole former is cut away, so that its upper half 172 can seat atop the trough former. Therefore, the inner diameter of the smaller section is about equal to the outer diameter of the arch 174 in the "U" of the trough former. Additionally, the outer ends 176 of the hole formers are not planar, but rather are bounded by an imaginary cylindrical surface having a radius equal to the interior diameter of the outer jacket.

Once the mold parts have been placed, concrete is poured into the mold and allowed to set. Thereafter, hydraulic rams press the product off the mold, and the hole formers are knocked out of the resulting monolithic manhole base.

FIG. 6 shows the base section produced by the mold of FIG. 5. Note the well-elevated pads 180 that result from this mold. The drawings cannot depict, however, several advantages of the invention, chief among these the ease with which the mold pieces are assembled, and the simplicity of mold setup for various configurations. Since the dome and trough former arcs have the same radius, and are welded together, there is no leakage of concrete at their interface; a similar result occurs at the trough former—hole former interface.

The embodiment of the invention described above has the influent and outlet openings spaced 180° apart, with the trough extending straight between the openings. While this may be the most common configuration, it is common for non-colinear pipes to meet at a manhole. Therefore, we contemplate applying the principles of the invention to other configurations, representative ones of which are shown in FIGS. 6 and 7. In each of those figures, the trough former 174' or 174" is elbow-shaped, having two straight segments "S" that extend perpendicular to two points on the interior surface of the jacket. The straight segments are interconnected by a radiused segment "R" having the desired angle (90° or 135° in FIGS. 6 and 7, respectively). Such trough formers may be built up from separate pieces by welding. It is also possible that certain configurations may be deformed from plate material in a single piece, or that the hole formers could be cast. Also, while metal pierces are presently preferred, it is possible that it will prove advantageous to use other materials, including synthetic polymers, for various parts of the mold.

FIGS. 5, 6 and 7 show trough formers for connecting lines at 180°, 90° and 135° angles, respectively. It is contemplated that in practice, a wider variety of trough formers will be made available, for example at 15° intervals.

Since the invention is subject to modifications and variations, it is intended that the foregoing description and the accompanying drawings shall be interpreted as illustrative of only one form of the invention, whose scope is to be measured by the following claims.

I claim:

1. A mold for casting an inverted base section of a manhole, said mold comprising a core for forming an inner surface of the base section, a jacket surrounding the core for forming an outer surface of the base section, said jacket having an interior surface and defining an annular space between it and said core, means for closing the bottom of the annular space, a domed plate atop the core but below an upper edge of said jacket, and having a peripheral shape corresponding to that of the core, for preventing cementitious material from leaking into the core, and a trough former extending between points on the interior of said jacket above said domed plate, said trough former having downwardly projecting flanges, said flanges being cut along arcs conforming to the shape of said domed plate so that when cementitious material is poured into said mold, the material does not leak substantially between the domed plate and the trough former, and at least one hole former, slid hole former having a cylindrical portion whose interior diameter substantially equals that of the trough former's arch, part of the cylindrical portion being cut away so that the hole former can be seated on the trough former.

2. The invention of claim 1, wherein said domed plate is a segment of a spherical shell and said trough former flanges are cut along an arc whose radius corresponds substantially to that of said domed plate.

3. The invention of claim 10 wherein said trough former has an inverted "U" section with a radiused arch, said flanges protruding downwardly from the arch toward the domed plate.

4. The invention of claim 3, wherein a lower half of said portion is cut out where the hole former seats on the trough former.

5. The invention of claim 4, wherein the hole former has a cylindrically stepped configuration so that it can accept pipes of different diameters.

6. The invention of claim 1, wherein the trough former is welded to the domed plate along said arcs.

7. A method of making a mold for inverse casting of a base section of a manhole, comprising steps of placing a cylindrical jacket around a cylindrical core so as to define an annular space therebetween, sealing the bottom of the annular space, covering the top of the core with a domed plate for producing a dished floor in the base section, conforming a trough former, having an inverse U-section defining an arch and a pair of flanges extending downward therefrom, to the domed plate's shape by cutting the flanges along arcs having radii substantially equal to that of the domed plate, placing the trough former upon the domed plate with the flange arcs in contact with the domed plate, and seating hole formers, having portions removed therefrom, atop the trough former and in contact with said jacket.

* * * * *